US010770243B2

(12) United States Patent
Wu

(10) Patent No.: US 10,770,243 B2
(45) Date of Patent: Sep. 8, 2020

(54) PUSH-BUTTON SWITCH WITH GOOD BALANCE

(71) Applicant: DONGGUAN CITY KAIHUA ELECTRONICS CO., LTD, Dongguan, Guangdong (CN)

(72) Inventor: Fuxi Wu, Guangdong (CN)

(73) Assignee: DONGGUAN CITY KAIHUA ELECTRONICS CO., LTD, Dongguan, Guangdong (CN)

( * ) Notice: Subject to any disclaimer, the term of this patent is extended or adjusted under 35 U.S.C. 154(b) by 0 days.

(21) Appl. No.: 16/474,046

(22) PCT Filed: Dec. 22, 2017

(86) PCT No.: PCT/CN2017/117911

§ 371 (c)(1),
(2) Date: Jun. 26, 2019

(87) PCT Pub. No.: WO2018/121422

PCT Pub. Date: Jul. 5, 2018

(65) Prior Publication Data

US 2019/0341205 A1 Nov. 7, 2019

(30) Foreign Application Priority Data

Dec. 26, 2016 (CN) ..... 2016 1 1219898

(51) Int. Cl.

| | |
|---|---|
| ***H01H 13/14*** | (2006.01) |
| ***H01H 13/02*** | (2006.01) |
| ***H01H 13/10*** | (2006.01) |
| ***H01H 13/52*** | (2006.01) |

(52) U.S. Cl.
CPC ..... *H01H 13/14* (2013.01); *H01H 13/023* (2013.01); *H01H 13/10* (2013.01); *H01H 13/52* (2013.01)

(58) Field of Classification Search
CPC ..... H01H 13/14; H01H 13/023; H01H 13/10; H01H 13/52; H01H 2013/525; H01H 3/125
See application file for complete search history.

(56) References Cited

U.S. PATENT DOCUMENTS

| | | | | |
|---|---|---|---|---|
| 10,388,474 | B2 * | 8/2019 | Wu | H01H 13/86 |
| 2017/0294276 | A1 * | 10/2017 | Liu | H01H 13/14 |
| 2019/0172661 | A1 * | 6/2019 | Hsieh | H01H 13/10 |

* cited by examiner

*Primary Examiner* — Edwin A. Leon
*Assistant Examiner* — Lheiren Mae A Caroc

(57) ABSTRACT

A push-button switch with good balance, including a base, a cover covering the base, a press core, a torsion spring, a conductive assembly and a press core slider, which are respectively arranged on the base. A guide pillar provided with guide hole is protruded upwardly from a center of the base. Two baffles are arranged on the base and at opposite sides of the guide pillar to form an annular receiving slot provided with a balance rod assembly formed by a first and a second balance rod cross-connected with each other, two crossing junctions of which are limited by a positioning slider. A cylinder is protruded downward from a center of an annular slot formed at a lower end of the press core. The cylinder and the guide pillar are respectively inserted into the guide hole and the annular slot. The guide pillar is sleeved with a spring.

13 Claims, 8 Drawing Sheets

PUSH-BUTTON SWITCH WITH GOOD BALANCE

CROSS-REFERENCE TO RELATED APPLICATIONS

This application is a continuation of International Patent Application No. PCT/CN2017/117911, filed on Dec. 22, 2017, which claims the benefit of priority from Chinese Application No. 201611219898.7, filed on Dec. 26, 2016. The entirety of each of the above-mentioned patent applications is hereby incorporated by reference herein and made a part of this specification.

TECHNICAL FIELD

The present disclosure relates to a push-button switch, and more particularly to a push-button switch with good balance.

BACKGROUND OF THE INVENTION

Push-button switch is generally used as an input means for operating an electronic equipment. The quality of the push-button switch determines the experience of an relating input device, which requires the push-button switch to be made with a good touch feeling and acoustic feeling. The existing thin push-button switch using a metal piece as a moving contact piece lacks a touch feeling like a large push-button switch because of the limitation of the internal space in the switch. Moreover, due to the unreasonable internal structure design, the compression stability of the existing switch is poor, resulting in unsmooth pressing and affecting normal use. Furthermore, the existing switch often generates unsmooth stagnation during pressing, which affects the press feeling.

SUMMARY OF THE INVENTION

In order to solve the above deficiencies, an object of embodiments of the present disclosure is to provide a push-button switch with good balance, which has a reasonable structure, thereby significantly improving the press balance and press stability, eliminating the unsmooth stagnation, and enhancing the press feeling.

One embodiment of the present invention provides a push-button switch with good balance, including a base and a cover covering the base. The cover is provided with an orifice. The push-button switch further includes a press core, a torsion spring, a conductive assembly and a press core slider, which are respectively arranged on the base. A guide pillar is protruded upwardly from a center position of an upper end of the base, and a guide hole is arranged in a center of the guide pillar. One end of the base is provided with a conductive assembly slot configured to accommodate the conductive assembly, the other end of the base is provided with a torsion spring slot configured to accommodate the torsion spring. Two baffles are arranged on the upper end of the base and at each of opposite sides of the guide pillar. A gap is provided between the two baffles, such that an annular receiving slot is formed around the baffles and the guide pillar. The press core slider is arranged at a side of the press core. An annular slot is formed at a lower end of the press core. A cylinder is protruded downward from a center position of the annular slot. The cylinder is inserted into the guide hole of the base, and the guide pillar of the base is inserted into the annular slot. The guide pillar and the outer side of the cylinder are sleeved with a spring. A balance rod assembly is arranged in the annular receiving slot. The balance rod assembly is split-type and formed by a first balance rod and a second balance rod cross-connected with each other. The first balance rod and the second balance rod are both clamped at the lower end of the press core. Two crossing junctions of the first balance rod and the second balance rod are limited by a positioning slider arranged in the annular receiving slot and in the gap between the two baffles at the same side. During the process of moving up and down of the press core, the first balance rod and the second balance rod swing up and down under the limit of the positioning slider, thereby keeping a press balance.

As a further improvement of the present invention, a side edge of the positioning slider is provided with a limiting slot for clamping the first balance rod and the second balance rod. The limiting slot is provided with an opening. An upper portion and a lower portion of the opening are respectively bent inwardly to form protrusions.

As a further improvement of the present invention, the limiting slot has an arc shape.

As a further improvement of the present invention, each end face of the protrusions has an angle.

As a further improvement of the present invention, a convex rib is arranged on a side wall of the positioning slider and faces the side edge of the press core.

As a further improvement of the present invention, a groove is formed in a lower end surface of the press core, such that a plurality of convex corners are formed in the lower end surface of the press core.

As a further improvement of the present invention, a plurality of relief slots for being inserted by the convex corners or a plurality of relief holes for being passed through by the convex corners are provided on the base and outside of the guide pillar.

As a further improvement of the present invention, an upper end of the cylinder of the press core is formed with a mounting hole, and an LED lamp is arranged in the mounting hole.

As a further improvement of the present invention, the first balance rod and the second balance rod are both U-shaped. An open end of the first balance rod and an open end of the second balance rod are arranged to cross each other. The first balance rod includes a first transverse rod and first longitudinal rods respectively connected to two ends of the first transverse rod. An end of each of the first longitudinal rods is provided with a first hook bent outwardly. The second balance rod includes a second transverse rod and second longitudinal rods respectively connected to two ends of the second transverse rod. An end of each of the second longitudinal rods is provided with a second hook bent inwardly. The first transverse rod is arranged at a lower end of one side of the press core, and the second transverse rod is arranged at a lower end of the other side of the press core.

As a further improvement of the present invention, the conductive assembly includes a static piece and a movable piece.

The invention has the following beneficial effects.

(1) The first balance rod and the second balance rod are built-in and split-type. The first balance rod and the second balance rod swing up and down under the limit of the positioning slider to achieve a press balance, thereby significantly improving press balance and press stability.

(2) The convex corners and the relief slots or the relief holes serving as the relief positions of the base are adopted to provide a relief space for the convex corners. The length of fit before the sliding between the press core and the base is lengthened, which eliminates the unsmooth stagnation. Meanwhile, the height of the push-button switch is lowered, so that the overall thickness of the push-button switch is thinner.

(3) The torsion spring is adopted to enhance the press feeling and make a press sound.

The above illustration is an overview of the technical solutions of the present invention, and the present invention will be further described below with reference to the accompanying drawings and specific embodiments.

DETAILED DESCRIPTION OF EMBODIMENTS

Figure 1:
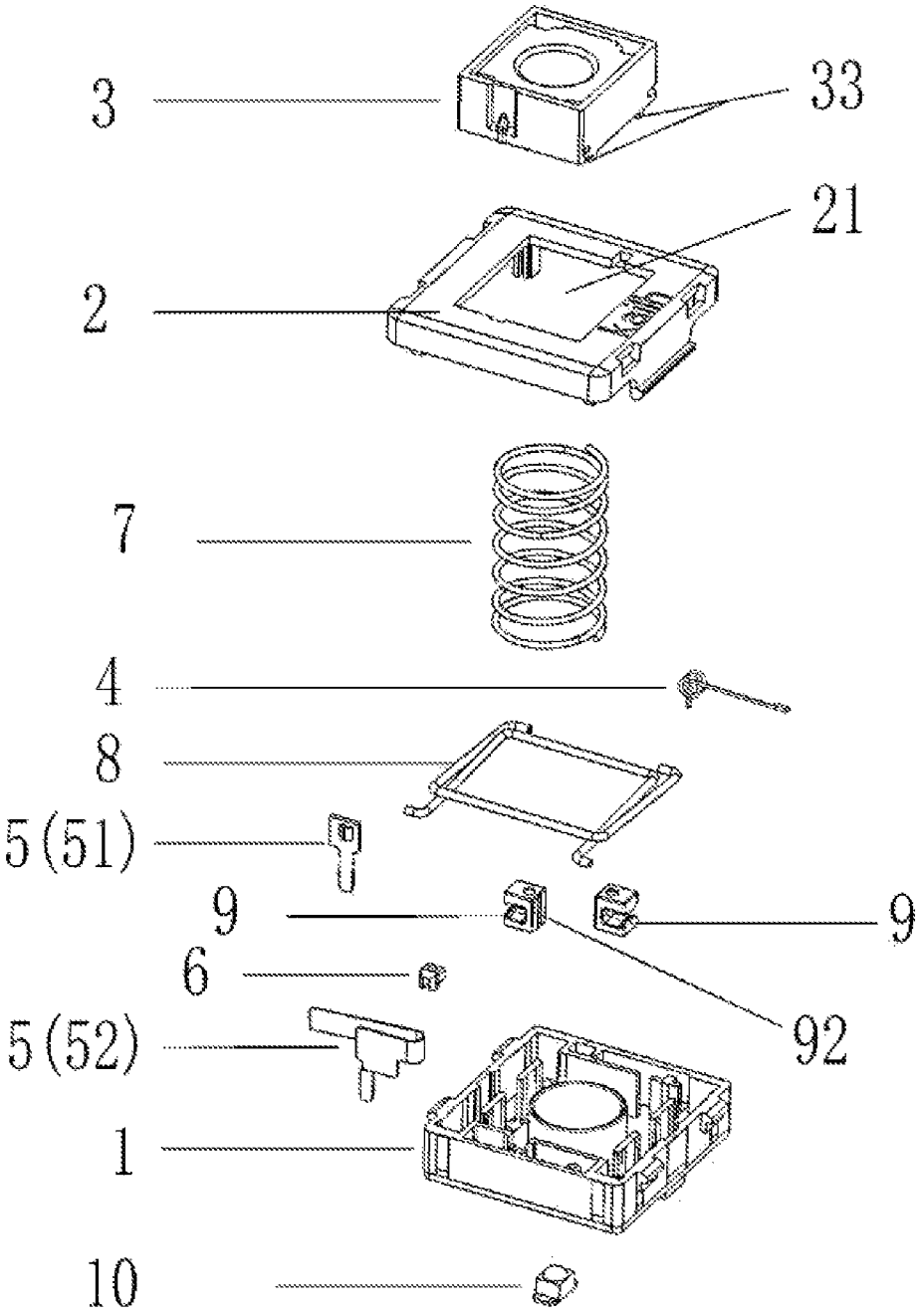
FIG. 1 is an assembly diagram according to embodiment 1.

In order to more clearly illustrate the technical solutions and merits of the present invention, the specific embodiments will be described in detail with reference to the accompanying drawings and preferred embodiments.

Embodiment 1

Referring to FIGS. 1-11, the present embodiment provides a push-button switch with good balance, including a base 1 and a cover 2 covering the base 1. The cover 2 is provided with an orifice 21. The push-button switch further includes a press core 3, a torsion spring 4, a conductive assembly 5 and a press core slider 6, which are respectively arranged on the base 1. A guide pillar 11 is protruded upwardly from a center position of an upper end of the base 1, and a guide hole 12 is arranged in a center of the guide pillar 11. One end of the base 1 is provided with a conductive assembly slot 14 configured to accommodate the conductive assembly 5, the other end of the base 1 is provided with a torsion spring slot 15 configured to accommodate the torsion spring 4. Two baffles 17 are arranged on the upper end of the base 1 and at each of opposite sides of the guide pillar 11. A gap is provided between the two baffles 17, such that an annular receiving slot 13 is formed around the baffles 17 and the guide pillar 11. The press core slider 6 is arranged at a side of the press core 3. An annular slot 31 is formed at a lower end of the press core 3. A cylinder 32 is protruded downward from a center position of the annular slot 31. The cylinder 32 is inserted into the guide hole 12 of the base 1, and the guide pillar 11 of the base 1 is inserted into the annular slot 31. The guide pillar 11 and the outer side of the cylinder 32 are sleeved with a spring 7. A balance rod assembly 8 is arranged in the annular receiving slot 13. The balance rod assembly 8 is split-type and formed by a first balance rod 81 and a second balance rod 82 cross-connected with each other. The first balance rod 81 and the second balance rod 82 are both clamped at the lower end of the press core 3. Two crossing junctions of the first balance rod 81 and the second balance rod 82 are limited by a positioning slider 9 arranged in the annular receiving slot 13 and in the gap 171 between the two baffles 17 at the same side. During the process of moving up and down of the press core 3, the first balance rod 81 and the second balance rod 82 swing up and down under the limit of the positioning slider 9. The positioning slider 9 can only move vertically, but cannot move laterally, thereby keeping a press balance.

Figure 5:
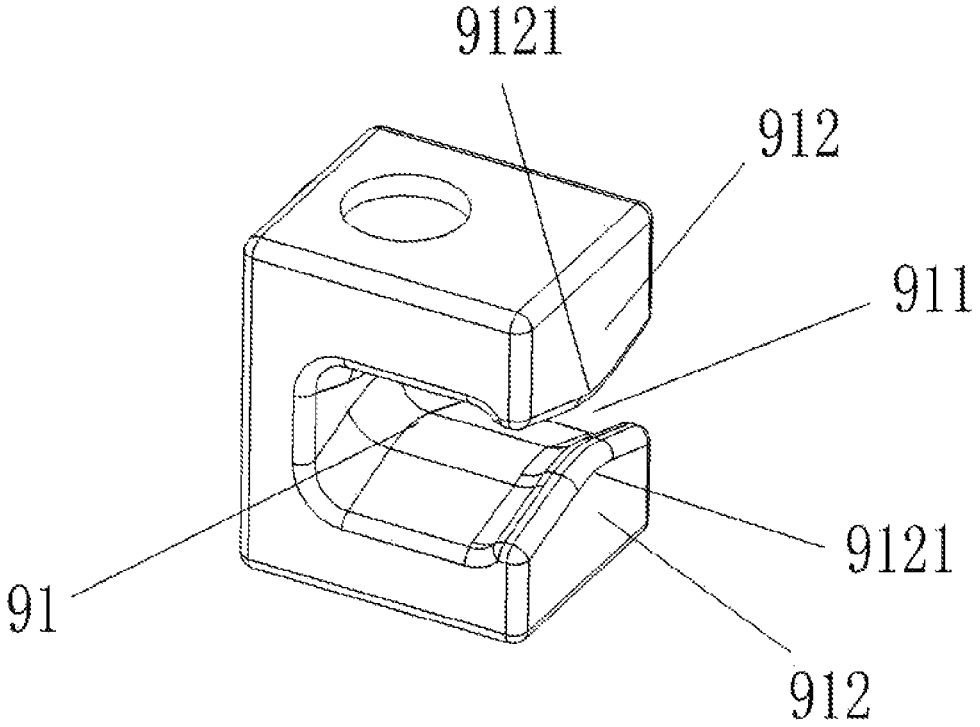
FIG. 5 is a schematic diagram of a positioning slider according to embodiment 1.

In the present embodiment, as shown in FIG. 5, a side edge of the positioning slider 9 is provided with a limiting slot 91 for clamping the first balance rod 81 and the second balance rod 82. The limiting slot 91 is provided with an opening 911. An upper portion and a lower portion of the opening 911 are respectively bent inwardly to form protrusions 912. Each end face of the protrusions 912 has an angle 9121, which is set according to the height of the push-button switch. Meanwhile, the limiting slot 91 has an arc shape.

As shown in FIG. 1, a convex rib 92 is arranged on a side wall of the positioning slider 9 and faces the side edge of the press core 3. The convex rib 92 is configured to reduce a contact area between the positioning slider 9 and the press core 3, thereby reducing the friction between the positioning slider 9 and the outer wall of the press core 3.

Figure 2:
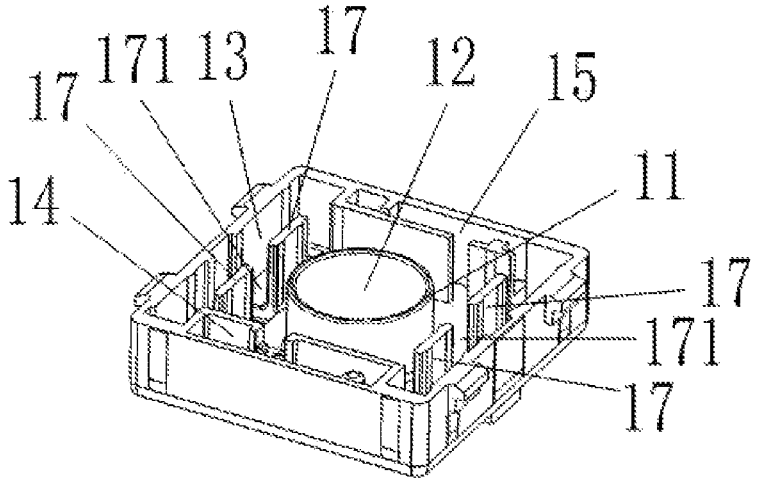
FIG. 2 is a schematic diagram of a base according to embodiment 1.
Figure 3:
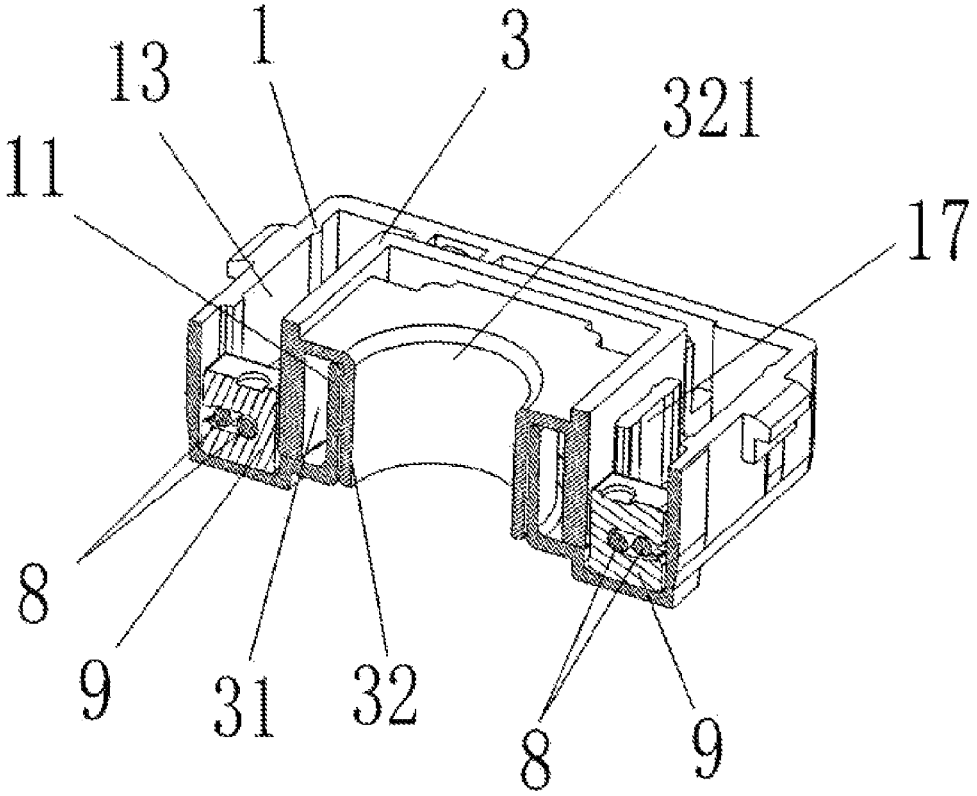
FIG. 3 is a cross-sectional view according to embodiment 1.

As shown in FIG. 2, an upper end of the cylinder 32 of the press core is formed with a mounting hole 321, and an LED lamp 10 is arranged in the mounting hole 321 to achieve alight-emitting function in the center of the push-button switch.

Figure 4:
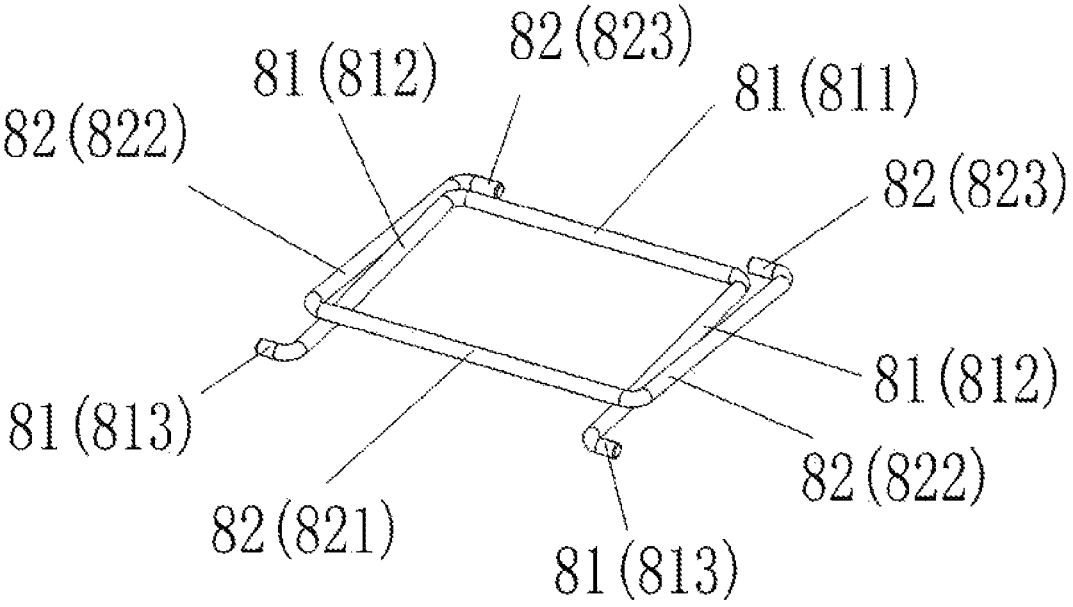
FIG. 4 is a schematic diagram of a balance rod assembly according to embodiment 1.

As shown in FIG. 4, the first balance rod 81 and the second balance rod 82 are both U-shaped. An open end of the first balance rod 81 and an open end of the second balance rod 82 are arranged to cross each other. The first balance rod 81 includes a first transverse rod 811 and first longitudinal rods 812 respectively connected to two ends of the first transverse rod 811. An end of each of the first longitudinal rods 812 is provided with a first hook 813 bent inwardly. The second balance rod 82 includes a second transverse rod 821 and second longitudinal rods 822 respectively connected to the two ends of the second transverse rod 821. An end of each of the second longitudinal rods 822 is provided with a second hook 823 bent inwardly. The first transverse rod 811 is arranged at a lower end of the press core 3, and the second transverse rod 821 is arranged at a lower end of the other side of the press core 3. In the present embodiment, the first balance rod 81 and the second balance rods 82 are built-in and split-type. The positioning sliders 9 at the two crossing junctions slide up and down in the annular receiving slot 13 of the base 1, so that the first balance rod 81 and the second balance rods 82 are slidably connected, thereby achieving the press balance.

In the present embodiment, the conductive assembly 5 includes a static piece 51 and a movable piece 52.

Embodiment 2

Figure 12:
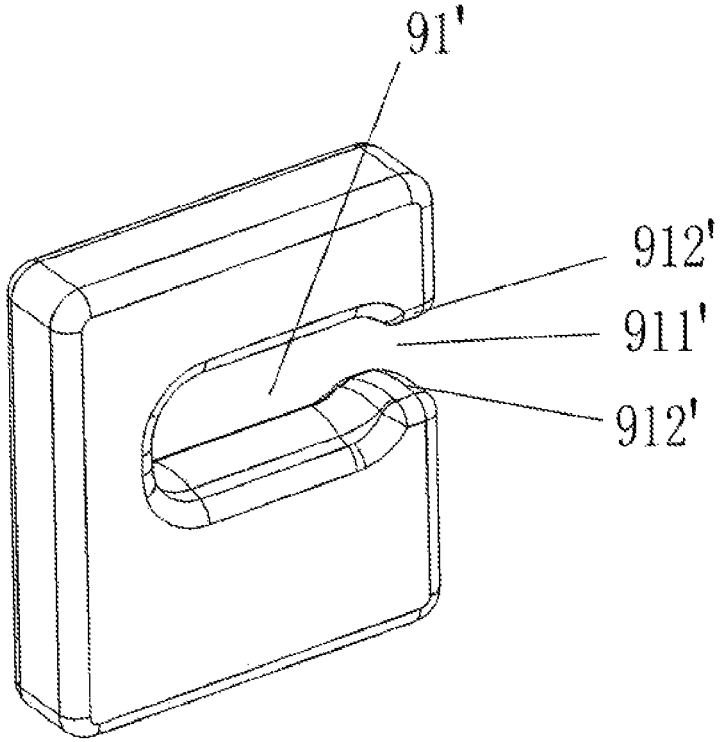
FIG. 12 is a schematic diagram of the positioning slider according to embodiment 2.
Figure 13:
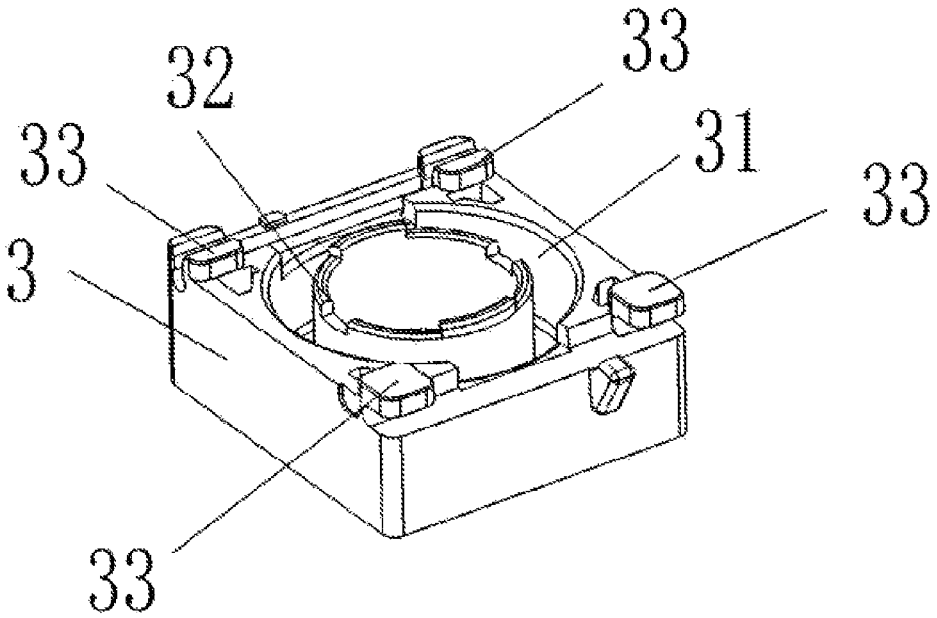
FIG. 13 is a schematic diagram of a bottom of the press core according to embodiment 3.
Figure 14:
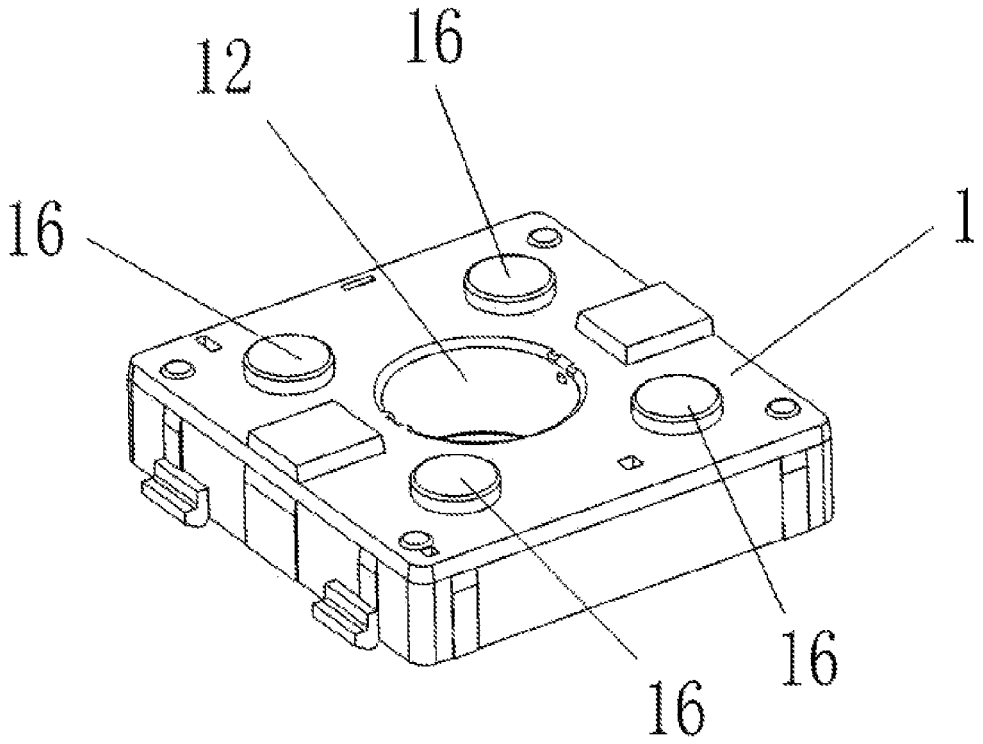
FIG. 14 is a schematic diagram of a bottom of the base according to embodiment 3.
Figure 15:
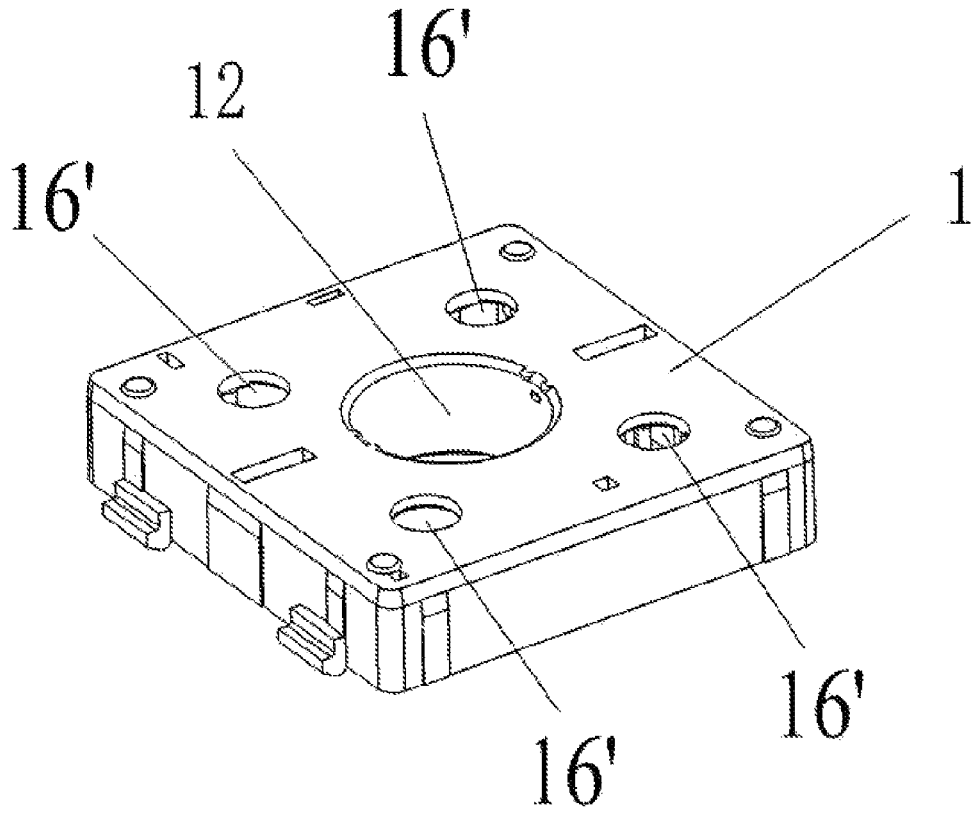
FIG. 15 is another schematic diagram of the bottom of the base according to embodiment 3.

As shown in FIG. 12, a side edge of the positioning slider 9' of the present embodiment is also provided with an arc limiting slot 91' for clamping the first balance rod 81 and the second balance rod 82. The limiting slot 91' has an opening 911', and the upper portion and the lower portion of the opening 911' are respectively bent inwardly to form protrusions 912'. However, the main difference between the present embodiment and the embodiment 1 is that the end faces of the protrusions 912' in the present embodiment have no angle. The thickness of the positioning slider 9' of the present embodiment is thinner than that of the positioning slider 9 of the embodiment 1.

Embodiment 3

As shown in FIGS. 7, 10, 13-15, the main difference between the present embodiment and the embodiment 1 is, that a groove is formed in a lower end surface of the press core 3, such that a plurality of convex corners 33 are formed in the lower end surface of the press core 3. Meanwhile, a relief space is provided for the convex corners 33 by two manners. In one manner, a plurality of relief slots 16 for being inserted by the convex corners 33 are provided on the base 1 and outside of the guide pillar 11. In the other manner, a plurality of relief holes 16' for being passed through by the convex corners 33 are provided on the base 1 and outside of the guide pillar 11.

In the present embodiment, the relief slots 16 and the relief holes 16' have the same number as that of the convex corners 33. In the present embodiment, the number of the convex corners 33 is four, while the convex corners 33 may also be set to two or more according to specific needs.

Moreover, the height of the convex corners 33 can be set according to specific needs. In the present embodiment, preferably, the height of the convex corners 33 is 0.4 mm. Through the matching of the convex corners 33 and the relief slots 16 or the relief holes 16', the relief slots 16 or the relief holes 16' are used as the avoidance position of the base 1, so that length of fit before the sliding between press core 3 and the base 1 is lengthened, which eliminates an unsmooth stagnation of the press core 3 when pressed. Meanwhile, the height of the push-button switch is lowered, so that the overall thickness of the push-button switch is thinner.

The working principle of the invention is as follows.

Figure 9:
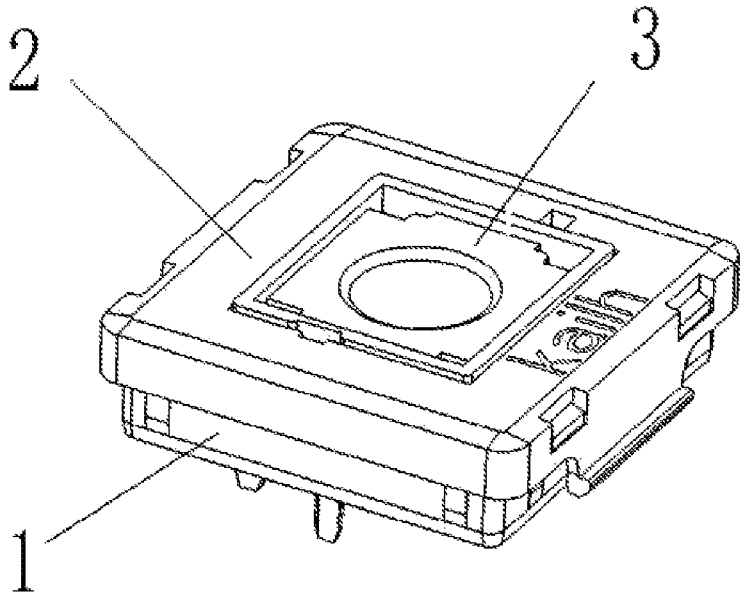
FIG. 9 is a perspective view showing the push-button switch of the present invention in a pressed state.
Figure 10:
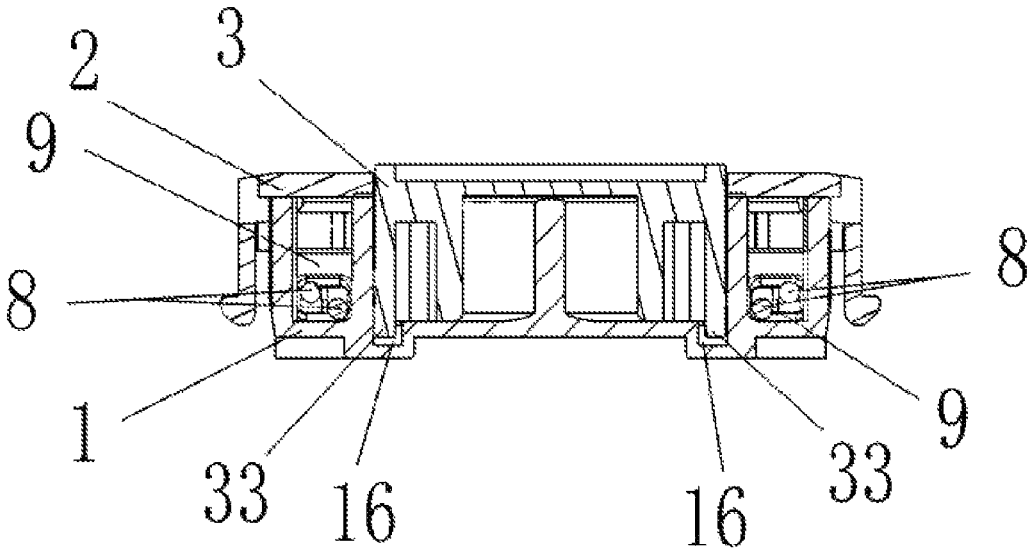
FIG. 10 is a cross-sectional view of the push-button switch of the present invention in a pressed state.
Figure 11:
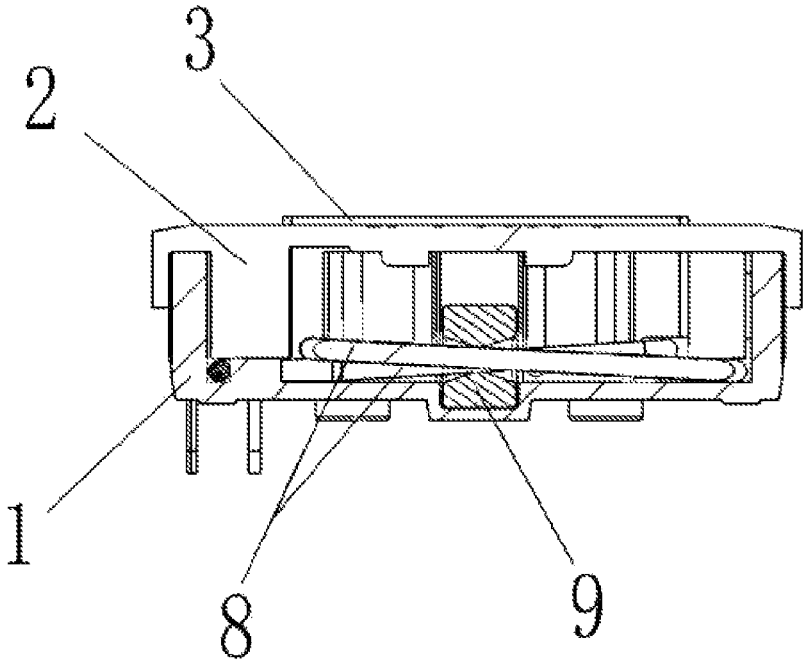
FIG. 11 is another cross-sectional view of the push-button switch of the present invention in a pressed state.

As shown in FIGS. 9-11, when the press core 3 is pressed down, the cylinder 32 of the press core 3 is inserted into the guide hole 12 of the base 1, and the convex corners 33 at the lower end of the press core 3 are inserted into the relief slots 16 or the relief holes 16' of the base 1. Meanwhile, the guide pillar 11 of the base 1 is inserted into the annular slot 31 of the press core 3, and the spring 7 is compressed to make the static piece 51 of the conductive assembly 5 touch with the movable piece 52 so as to perform a turn-on operation of the push-button switch. Meanwhile, the lower end of the press core 3 respectively applies a downward force on the first transverse rod 811 of the first balance rod 81 and the second transverse rod 821 of the second balance rod 82. The first balance rod 81 and the second balance rod 82 swing up and down under the limit of the positioning slider 9 to keep the press balance.

Figure 6:
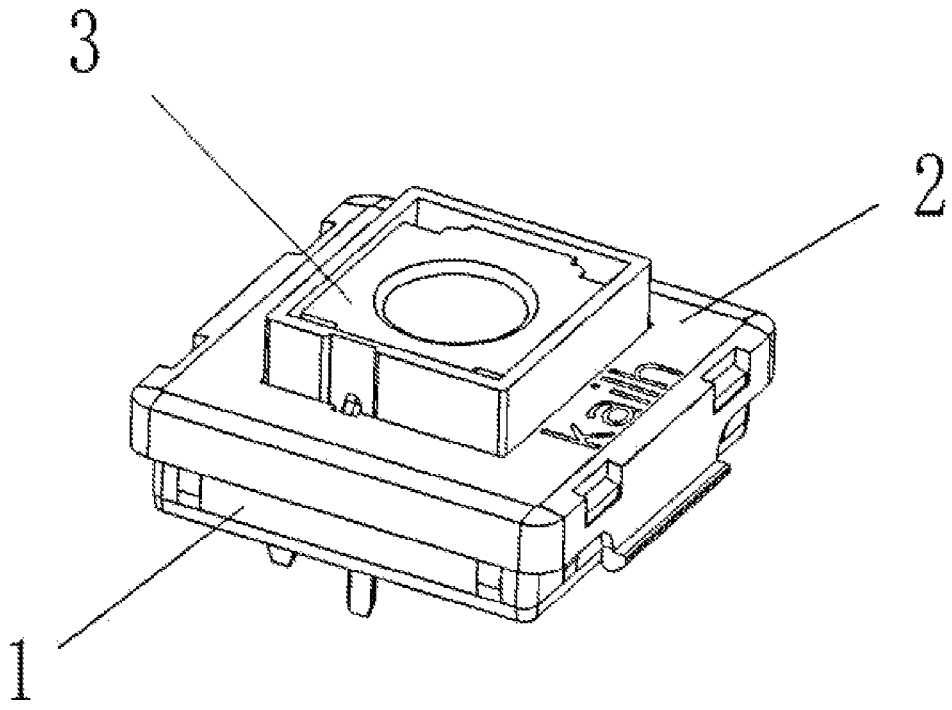
FIG. 6 is a perspective view showing a push-button switch of the present invention in a free state.
Figure 7:
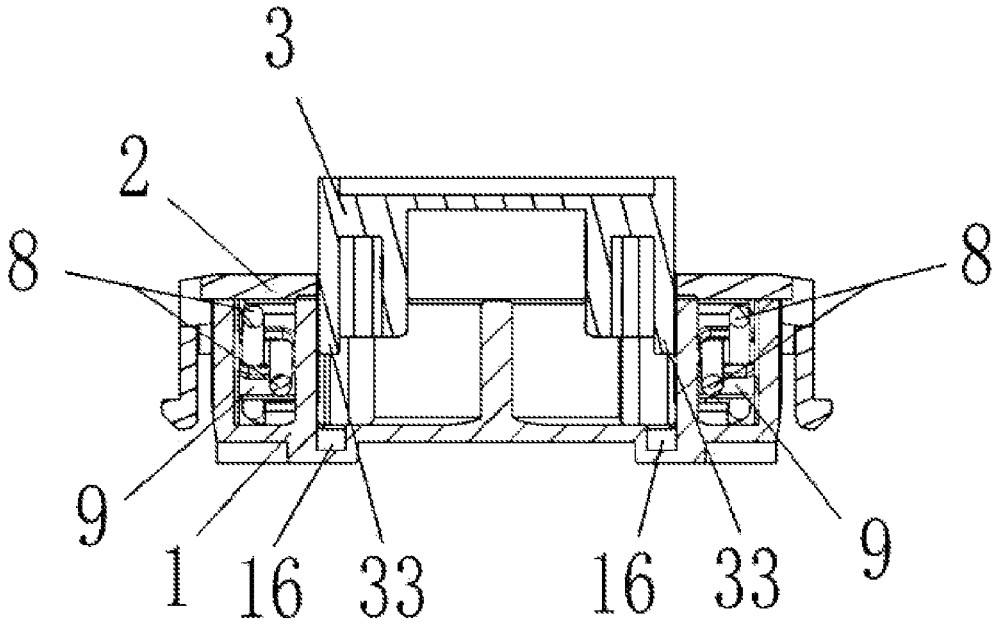
FIG. 7 is a cross-sectional view of the push-button switch of the present invention in a free state.
Figure 8:
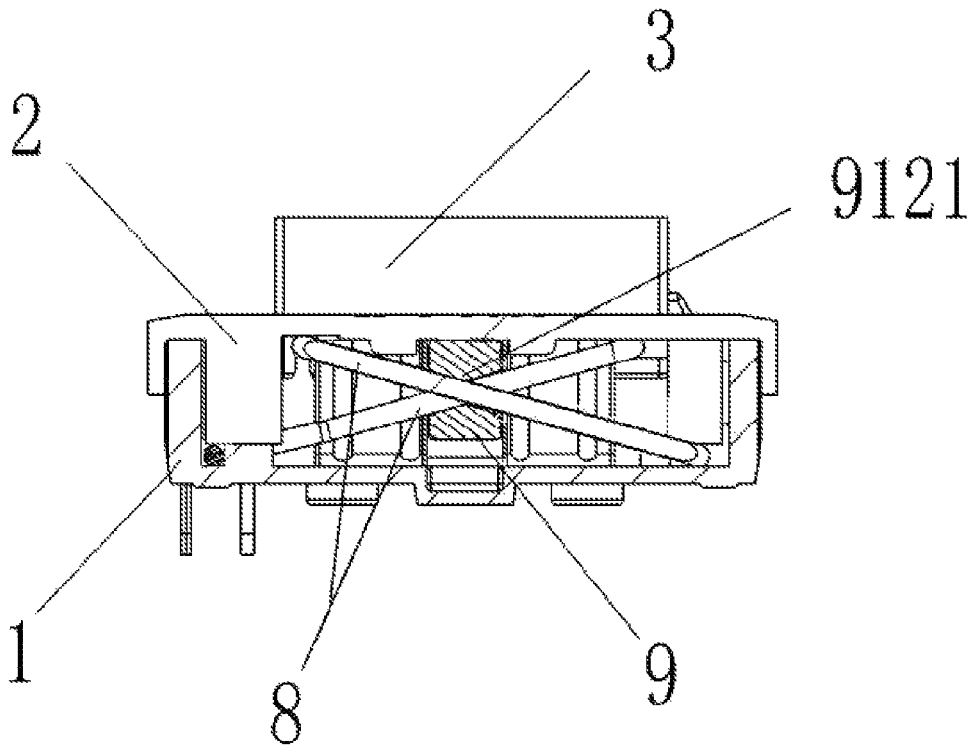
FIG. 8 is another cross-sectional view of the push-button switch of the present invention in a free state.

As shown in FIGS. 6-8, when the press force on the press core 3 is removed, the press core 3 is moved upward and the upper end of the press core 3 passes through the orifice 21 of the cover 2 to return to the original position by the elastic force of the spring 7. Meanwhile, the static piece 51 of the conductive assembly 5 is separated from the movable piece 52 so as to perform a turn-off operation of the push-button switch.

The key points of the invention are as follows.

(1) The first balance rod and the second balance rod are built-in and split-type. The first balance rod and the second balance rod swing up and down under the limit of the positioning slider to achieve a press balance, thereby significantly improving press balance and press stability.

(2) The convex corners and the relief slots or the relief holes serving as the relief positions of the base are adopted to provide a relief space for the convex corners. The length of fit before the sliding between the press core and the base is lengthened, which eliminates the unsmooth stagnation. Meanwhile, the height of the push-button switch is lowered, so that the overall thickness of the push-button switch is thinner.

(3) The torsion spring is adopted to enhance the press feeling and make a press sound.

The above description is only the preferred embodiments of the present disclosure and are not intended to limit the present technical disclosure. Any modifications, equivalent replacements, and alterations made within the spirits and principles of the present technical disclosure shall be included in the scope of the present disclosure.

What is claimed is:

1. A push-button switch with good balance, comprising: a base and a cover covering the base; wherein the cover is provided with an orifice; the push-button switch further comprises a press core, a torsion spring, a conductive assembly and a press core slider, which are respectively arranged on the base; a guide pillar is protruded upwardly from a center of an upper end of the base; a guide hole is formed in a center of the guide pillar; one end of the base is provided with a conductive assembly slot configured to accommodate the conductive assembly, an other end of the base is provided with a torsion spring slot configured to accommodate the torsion spring; two baffles are arranged on the upper end of the base and at each of opposite sides of the guide pillar, a gap is provided between the two baffles, such that an annular receiving slot is formed around the two baffles and the guide pillar; the press core slider is arranged at a side of the press core; an annular slot is formed at a lower end of the press core; a cylinder is protruded downward from a center position of the annular slot; the cylinder is inserted into the guide hole of the base, and the guide pillar of the base is inserted into the annular slot; the guide pillar and an outer side of the cylinder are sleeved with a spring; a balance rod assembly is arranged in the annular receiving slot; the balance rod assembly is split-type and formed by a first balance rod and a second balance rod cross-connected with each other; the first balance rod and the second balance rod are both clamped at the lower end of the press core; two crossing junctions of the first balance rod and the second balance rod are limited by a positioning slider arranged in the annular receiving slot and in the gap between the two baffles at a same side; a side edge of the positioning slider is provided with a limiting slot for clamping the first balance rod and the second balance rod; during a movement of the press core up and down, the first balance rod and the second balance rod swing up and down under a limit of the positioning slider, thereby keeping a press balance.

2. The push-button switch of claim 1, wherein the limiting slot is provided with an opening; an upper portion and a lower portion of the opening are respectively bent inwardly to form protrusions.

3. The push-button switch of claim 2, wherein the limiting slot has an arc shape.

4. The push-button switch of claim 3, wherein end faces of each protrusion form an angle.

5. The push-button switch of claim 4, wherein a convex rib is arranged on a side wall of the positioning slider and faces a side edge of the press core.

6. The push-button switch of claim 3, wherein a convex rib is arranged on a side wall of the positioning slider and faces a side edge of the press core.

7. The push-button switch of claim 2, wherein a convex rib is arranged on a side wall of the positioning slider and faces a side edge of the press core.

8. The push-button switch of claim 1, wherein a convex rib is arranged on a side wall of the positioning slider and faces a side edge of the press core.

9. The push-button switch of claim 1, wherein a groove is formed in a lower end surface of the press core, such that a plurality of convex corners are formed in the lower end surface of the press core.

10. The push-button switch of claim 9, wherein a plurality of relief slots for being inserted by the plurality of convex corners or a plurality of relief holes for being passed through by the plurality of convex corners are provided on the base and outside of the guide pillar.

11. The push-button switch of claim 1, wherein an upper end of the cylinder of the press core is formed with a mounting hole, and an LED lamp is arranged in the mounting hole.

12. The push-button switch of claim 1, wherein the first balance rod and the second balance rod are both U-shaped; an open end of the first balance rod and an open end of the second balance rod are arranged to cross each other; the first balance rod comprises a first transverse rod and first longitudinal rods respectively connected to two ends of the first transverse rod; an end of each of the first longitudinal rods is provided with a first hook bent outwardly; the second balance rod comprises a second transverse rod and second longitudinal rods respectively connected to two ends of the second transverse rod; an end of each of the second longitudinal rods is provided with a second hook bent inwardly; the first transverse rod is arranged at a lower end of one side of the press core, and the second transverse rod is arranged at a lower end of an other side of the press core.

13. The push-button switch of claim 1, wherein the conductive assembly comprises a static piece and a movable piece.

* * * * *